US011478718B1

(12) United States Patent
Laffin

(10) Patent No.: US 11,478,718 B1
(45) Date of Patent: Oct. 25, 2022

(54) BOAT MOTION SIMULATOR

(71) Applicant: DISNEY ENTERPRISES, INC., Burbank, CA (US)

(72) Inventor: Kristopher M. Laffin, Los Angeles, CA (US)

(73) Assignee: Disney Enterprises, Inc., Burbank, CA (US)

( * ) Notice: Subject to any disclaimer, the term of this patent is extended or adjusted under 35 U.S.C. 154(b) by 0 days.

(21) Appl. No.: 17/366,241

(22) Filed: Jul. 2, 2021

(51) Int. Cl.
*A63G 31/16* (2006.01)
*A63G 31/00* (2006.01)
*A63G 31/02* (2006.01)

(52) U.S. Cl.
CPC ..... *A63G 31/007* (2013.01); *A63G 31/02* (2013.01); *A63G 31/16* (2013.01)

(58) Field of Classification Search
CPC ..... A63G 31/16; A63G 31/007
USPC ..... 472/13, 59, 60, 128; 434/55
See application file for complete search history.

(56) References Cited

U.S. PATENT DOCUMENTS 5,219,315 A * 6/1993 Fuller ..... A63G 31/16 348/124
5,282,772 A * 2/1994 Ninomiya ..... A63G 31/16 104/73
2016/0001443 A1* 1/2016 Davis ..... A63G 31/16 74/490.08

* cited by examiner

*Primary Examiner* — Kien T Nguyen
(74) *Attorney, Agent, or Firm* — Snell & Wilmer L.L.P.; Kent A. Lembke

(57) ABSTRACT

A boat motion simulator or system configured specially to impart boat-type motions (e.g., roll, sway, heave, pitch, surge, and yaw) to a passenger boat. The simulator or system is also configured to use buoyancy or buoyant forces to vertically support the boat such that the system's components imparting the boat motions do not provide vertical support of the boat, which, instead, floats naturally in a volume of water provided within the simulator or system while or concurrently with motions being imparted upon the boat by a drive or motion assembly. The simulator or system may also include a display and sound system operable with this drive or motion assembly to display imagery and a soundtrack that are synchronized with the motions imparted upon the boat by the drive or motion assembly to provide a unique and realistic boat simulator or boat ride experience for passengers in the boat.

20 Claims, 7 Drawing Sheets

BOAT MOTION SIMULATOR

BACKGROUND

Field of the Description

The present description relates, in general, to systems adapted to simulate motion of passenger vehicles, and, more particularly, to a system, which may be used in attractions of amusement and theme parks and other settings, designed to simulate motions of a boat in open waters for passengers on or in the boat.

Relevant Background

Amusement and theme park operators are continuously searching for new and exciting ways to entertain their visitors and to entice visitors to return to their parks. Often, it is desirable to create and build new rides and attractions to meet this need for new park experiences.

Water rides are some of the most beloved attractions at parks around the world, with park visitors enjoying and remembering their times on these water rides for years. However, water rides generally do not meet the demand for new and surprising ways to entertain visitors because the type of experience these rides provide has not significantly changed since they were first introduced to parks many years ago.

In a typical water ride, passengers (or park visitors or guests) load into a boat that is then placed in a flume with moving water. The boat may be guided in some portions of the ride but is often free to flow with the water that carries the boat throughout the ride path. The boats float naturally, and excitement is often introduced with rapids or external features such as water sprays or robotic creatures moving nearby. The passengers often experience relatively little of the boat's motion, with many boats being specifically designed, e.g., via wide-bodied rafts and the like, to provide a smooth ride with little pitch and yaw.

SUMMARY

The inventor recognized that there is a demand for a water ride or boat-based attraction that imparts more of a boat's motion to the passengers of a boat. For example, an attraction may simulate a water battle, and a passenger boat may move between two battling ships. The passenger boat may be pitching and rolling with the waves, shuttering with the cannon fire, and listing to one side when it starts sinking. Previous water rides could not achieve such movements in any controlled and repeatable manner.

To address this deficiency, a new ride or attraction system ("boat motion simulator") was created that provides a way of making boats perform actions that simulate these types of motions expected of a boat in open water (e.g., roll, sway, heave, pitch, surge, yaw, and shutter/vibrate), while still allowing the boat to feel, and be, naturally buoyant (as least periodically). With the new ride/attraction system, the passengers (e.g., park visitors) are able to truly be a part of the action instead of simply spectators of a show that happen to be in a boat.

More particularly, a system is provided for simulating boat motions including one or more of roll, pitch, surge, heave, sway, yaw, and shuttering/vibrating. The system includes a pool adapted to contain water to a predefined water level. The system further includes a passenger boat on a surface of the water. Additionally, the system includes a motion assembly having: (a) a chassis coupled to or integral with an underside of the passenger boat, wherein the chassis is positioned below the surface of the volume of water; (b) a plurality of tethers each with a first end coupled to the chassis; and (c) a plurality of drivers each coupled with a second end of one of the tethers. In the system, the passenger boat floats naturally on the surface of the volume of water in response to buoyancy forces acting on the underside of the passenger boat when the tethers each have a nominal length (i.e., the boat floats naturally in this operating state of the motion assembly). A boat-type motion is imparted upon the passenger boat when one or more of the drivers operates to reduce a length of one or more of the tethers from the nominal length and to pull the passenger boat toward a bottom of the pool.

In some embodiments, a second boat-type motion is sequentially imparted upon the passenger boat when one or more of the drivers operates to return the one or more of the tethers to the nominal length, whereby the buoyancy forces act on the underside of the passenger boat to cause the passenger boat to again float naturally. In these and other cases, each of the tethers may be an elongated flexible member (such as a metal cable or the like), and the drivers each may take the form of a motorized reel upon which the second end of the tether is wound.

In some implementations of the system, the tethers are four flexible elongated members each with a first end coupled to one of four mounting points on the chassis, and the four mounting points are arranged in horizontal plane in a rectangular pattern (such as one with its outer corners located outward from the sides of the boat). In some particular embodiments, the rectangular pattern is configured such that two of the mounting points are located on a port side of the passenger boat, two of the mounting points are located on a starboard side of the passenger boat, two of the mounting points are located proximate to a bow end of the passenger boat, and two of the mounting points are located proximate to a stern end of the passenger boat. Preferably, the drivers are independently and concurrently operable to modify lengths of the tethers (e.g., to retract one tether or cable, two retract pairs of the tethers, and to retract all of the tethers), and, in some cases, each of the drivers or a pulley associated each of the drivers is positioned on the bottom of the pool (so as to apply forces on the chassis to pull the boat downward in the water when the tether is retracted).

DETAILED DESCRIPTION OF THE PREFERRED EMBODIMENTS

Briefly, the following description describes a boat motion simulator or system (or attraction or ride system) configured specially to impart boat-type motions (e.g., roll, sway, heave, pitch, surge, and yaw) to a passenger boat. Significantly, the simulator or system is configured also to use buoyancy or buoyant forces to vertically support the boat such that the system's components imparting the boat motions do not provide vertical support of the boat, which, instead, floats in a volume of water provided within the simulator or system while or concurrently with motions being imparted upon the boat by a drive or motion assembly. The simulator or system may also include a display and sound system operable with this drive or motion assembly to display imagery (e.g., 360-degree or wrap-around/surround video, 3D video, and so on) and to provide sound effects and/or a soundtrack that are synchronized with the motions imparted upon the boat by the drive or motion assembly to provide a unique and realistic boat simulator or boat ride experience for passengers in the boat.

Figure 1:
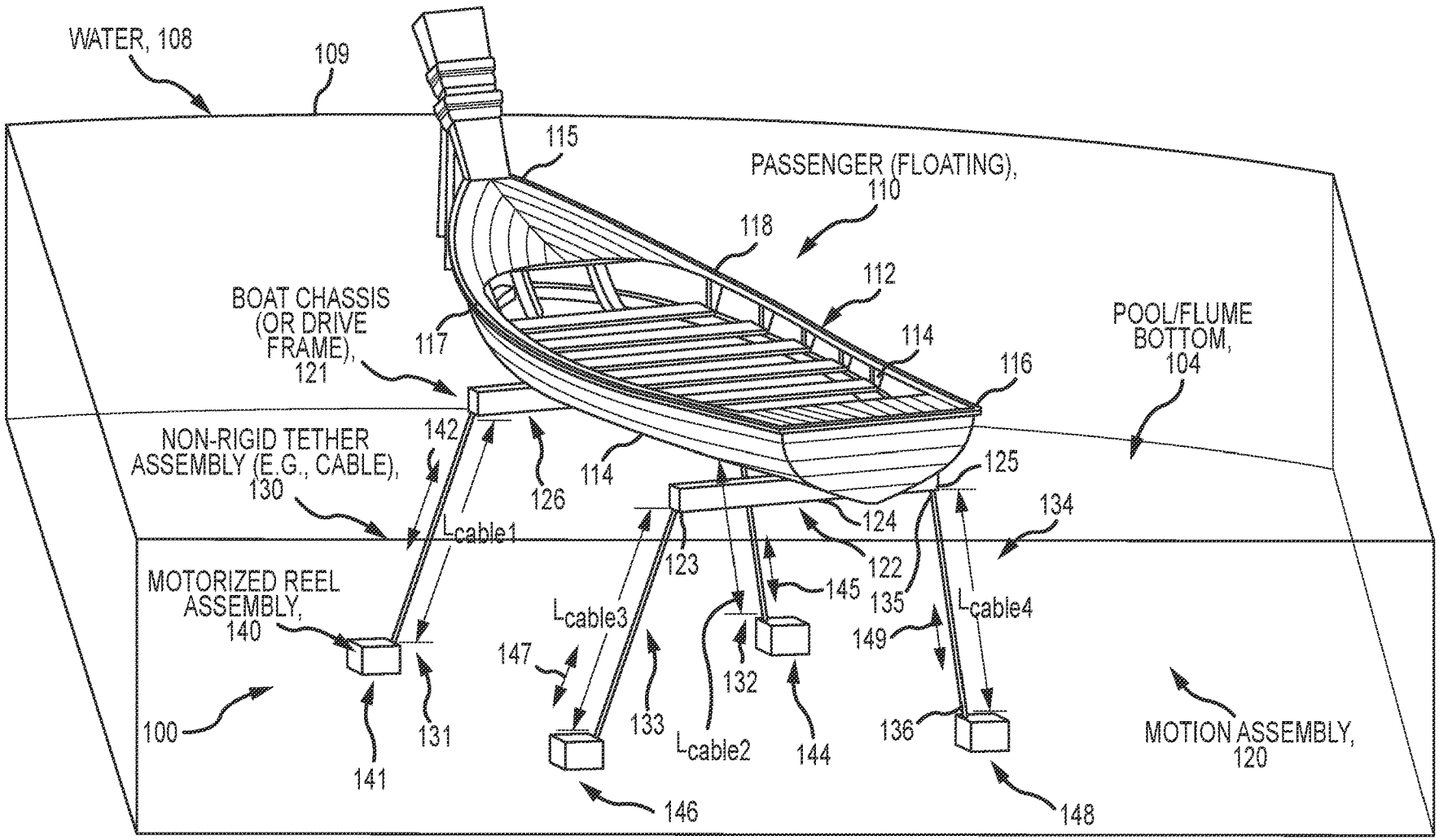
FIG. 1 is a top perspective view of a portion of a boat motion simulator or system configured to selectively provide boat-type motions to a passenger boat according to the present description.

FIG. 1 illustrates a boat motion simulator or system 100 adapted to provide an experience that simulates motions of a boat in open water during varying conditions in a controlled manner. The system 100 includes a volume of water 108 with an upper surface or water level 109, and the water 108 is contained in a structure (such as a pool or flume) with sidewalls (not shown for simplicity of illustration of the system 100) and a bottom 104. The system 100 further includes a passenger boat 110, which is allowed to float upon the surface 109, i.e., the boat 110 is vertically supported a distance (e.g., at the water level 109) above the bottom 104 by its buoyancy in the water 108 and not by drive members of the system 100.

The boat 110 is configured to be a passenger boat in which one, two, or more passengers may sit or stand with or without restraints. To this end, the boat 110 includes a body or hull 112, which may take a wide variety of forms and sizes to suit a desired application and which is formed of a material that is buoyant or that floats in water 108. To this end, the body 112 may have a bottom surface 113 that is solid or non-porous and made of a plastic, wood, metal, or other material useful for constructing boats to provide buoyancy and also provide a surface that supports passengers received in an interior compartment 114 of the body 112. The shape and other design features of the bottom surface 113 and body 112 may be chosen to achieve a desired amount of draft of the boat 110 when it is fully or partially loaded with passengers (not shown but understood to be receivable in compartment 114 such as standing or seated on bench-type seats shown in FIG. 1). The boat 110 has a bow or front end 115, a stern or back end 116, a port or left side 117, and a starboard or right side 118.

To impart selective boat-type motions on the boat 110, the system 100 includes a drive or motion assembly 120. This assembly 120 is typically wholly positioned some distance or depth below the water level or surface 109 such as 2 to 4 feet or more to hide the assembly 120 from view of passengers in the boat 110, which can also be furthered by low lighting for water 108 and/or by making the water 108 less transmissive of light.

The motion assembly 120 includes a boat chassis or drive frame 121 that provides anchoring locations for transmitting drive forces from the motion assembly 120 to the body/hull 112 of the boat 110. To this end, the boat chassis 121 may take a variety of forms with the illustrated design just being one useful example. As shown, the boat chassis 121 includes a rear or stern cross member 122 and a forward or bow cross member 126, which are rigidly coupled to the lower surface 113 of the body 112 of the boat 110 near the stern and bow 116 and 115, respectively, of the boat 110.

As shown, the cross members 122, 126 may be elongated struts or linear elements with a length that often matches or exceeds the width of the boat body 112, and each of the members 122, 126 extends orthogonally to the boat 110 (e.g., each has a longitudinal axis that is orthogonal to a longitudinal axis of the boat body 112 or to a direction of travel for the boat 110 when it has a circular shape rather than the elongated shape shown in FIG. 1). As shown with member 122, each may include a first end (left or port end) 123, a center point or midpoint 124, and a second end (right or starboard end) 125, and the member 122 may be rigidly coupled to the bottom surface 113 of the boat body 112 at or near the center point 124. Each member 124, 126 is typically formed to be rigid and to have adequate strength characteristics to transfer retention and drive forces to the body 112 with no or little deformation. In some embodiments, the chassis 121 may be provided as an integral part of the body/hull 112, e.g., providing anchor points for drive components on bow and stern portions of the bottom surface 113 (or at locations such as midpoint between the bow and stern 115 and 116).

Further, the motion assembly 120 includes a tether assembly 130 that includes two, three, four, or more tethers or restraint members that are of non-fixed or variable length (i.e., their lengths can be changed over time by operation of the motion assembly 120) and that are typically non-rigid (e.g., to facilitate natural movement of the tethered boat 110 and selectively changing each tether's length). As shown, the tether assembly 130 includes first, second, third, and four tethers 131, 132, 133, and 134, which may take the form of flexible cables, ropes, chains, or the like, with each having a length that can be changed (i.e., lengths labeled as $L_{Cable1}$, $L_{Cable2}$, $L_{Cable3}$, and $L_{Cable4}$) as shown with arrows 142, 145, 147, and 149, respectively. The first and second tethers 131 and 132 may be thought of as bow tethers and are coupled to opposite outer ends of the bow cross member 126. The third and fourth tethers 133 and 134 may be thought of as stern tethers and are coupled to opposite outer ends of the stern cross member 122. As shown in an exemplary manner with tether 134, the tether 134 is coupled at a first or upper end 135 to an outer end 125 of cross member 122 (e.g., one that is most proximate to its driver) and coupled at a second or lower end 136 to a driver/drive component 148.

To provide the changes 142, 145, 147, and 149 in the lengths, $L_{Cable1}$, $L_{Cable2}$, $L_{Cable3}$, and $L_{Cable4}$, the motion assembly 120 includes a motorized reel assembly 140. This assembly 140 includes a separate driver 141, 144, 146, and 148 for each of the four tethers 131, 132, 133, and 134 (and are coupled to the lower or second ends of each of the tethers 131, 132, 133, and 134 as shown for tether 134 at end 136 by driver 148). The drivers 141, 144, 146, and 148 are mounted on the pool/flume bottom 104 and within water 108 in some embodiments (as shown) or may be located further apart and out of the water 108 with coupling provided via a pulley system (and with a pulley or force directing element on the bottom 104 (in place of the drivers themselves)).

These drivers 141, 144, 146, and 148 may be operated independently to change any of the four lengths, $L_{Cable1}$, $L_{Cable2}$, $L_{Cable3}$, and $L_{Cable4}$, or concurrently (two, three, or all four drivers 141, 144, 146, and 148) to achieve a desired boat-type motion of boat 110. In one embodiment, the tethers 131, 132, 133, and 134 are lengths of a metal cable and each of the drivers 141, 144, 146, and 148 is a motorized reel (e.g., a reel and drive motor combination) upon which and from the cable may be spooled in response to drive signals from a controller to operate the drivers 141, 144, 146, and 148. The lengths, $L_{Cable1}$, $L_{Cable2}$, $L_{Cable3}$, and $L_{Cable4}$, are chosen to allow the boat 110 to float upon the water surface 109 in a normal manner while the tethers 131, 132, 133, and 134 remain taut (or have only a small, predefined amount of play or slack) even when no boat-like motion is being imparted by the motion assembly 120 (e.g., to allow the boat 110 to "bob" on the surface 109 in one operating state of the system 100 to further the illusion that the boat 110 is unsupported and untethered in the water 108).

The proposed boat motion simulator 100 is a system that provides a floating boat 110 with the ability to pitch, roll, heave, sway, and surge, all with the "natural" feel of a boat that is on the water 108. As shown in FIG. 1, the passenger boat 110 is floating in a pool of water 108 (with the pool/flume defined in part by the bottom 104). The boat 110 has a chassis 121 that is attached to the underside 113 of the boat 110 and is provided to attach cables or other tethers 131-134 (or actuators 141, 144, 146, and 148) to the outer corners of the boat body 112 (e.g., two at the bow 115 and two at the stern 116). In some embodiments (not shown), only a bow and a stern tether may be used (e.g., to provide some but not all of the boat-like motions) or three tethers may be used to achieve a differing subset of the motion or even the same or similar motion. While others may use 5, 6, or more, with four (as shown) providing a useful implementation with each tether 131-134 attached at a second end to motorized reels 141, 144, 146, and 148 positioned at the bottom 104 of the pool/flume (or located remotely through a series of pulleys to avoid use of underwater motors).

With components of the system 100 generally understood, it may be useful to describe the system 100 when it is being operated in several operating states or to provide differing boat-type motions. As noted above, FIG. 1 illustrates a first operating state in which the boat 110 is allowed, by having the lengths, $L_{Cable1}$, $L_{Cable2}$, $L_{Cable3}$, and $L_{Cable4}$, long enough, for example, to float on the water naturally (i.e., with no or little restraining forces applied by the motion assembly 120 on the boat 110).

Figure 2:
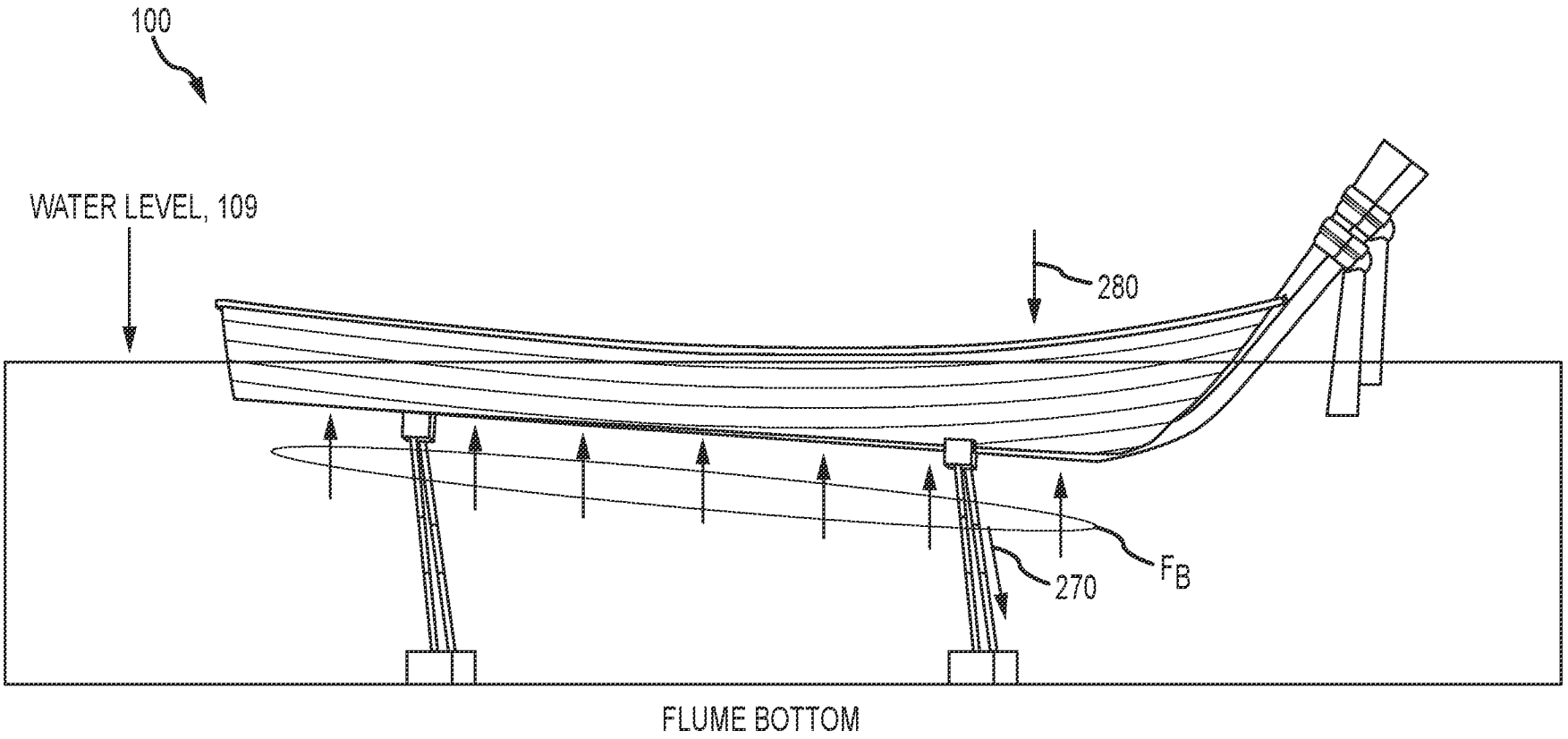
FIG. 2 is a side view of the system of FIG. 1 during motion assembly operations to cause the passenger boat to surge forward or the boat's bow to pitch downward.

FIG. 2 is a side view of the system 100 while it is operating the motion assembly 120 to cause the boat's bow 115 to pitch downward (or surge). During and prior to this motion, the water 108 is vertically supporting the boat 110 on the water surface 109 through buoyancy or applying buoyancy forces (as shown with arrows $F_B$) upon the underside or bottom surface 113 of the boat 110, which keeps the tethers 131-134 taut (e.g., with the lengths, $L_{Cable1}$, $L_{Cable2}$, $L_{Cable3}$, and $L_{Cable4}$, being equal and matching predefined nominal lengths in some cases). Then during the forward pitch operating state, as shown, the bow or forward drivers 141, 144 are concurrently and equally operated to retract or pull the front or bow tethers 131 and 132 downward toward the flume/pool bottom 104, as shown with arrow 270, which causes the front end or bow 115 of the boat body 112 to move downward into the water 108 with them (or move further below the surface/water level 109). As shown, since the boat 110 is floating, the buoyant force shown with arrows $F_B$ keeps the stern or rear tethers 133 and 134 taut, and the boat's bow or forward end 115 pitches downward. This operating state may end with the tethers 131 and 132 being returned to their nominal lengths via operations of the drivers 141 and 144 to play out more of the tethers 131 and 132 (e.g., unwind the motorized reels), which causes the bow end 115 to pitch back upward.

Figure 3:
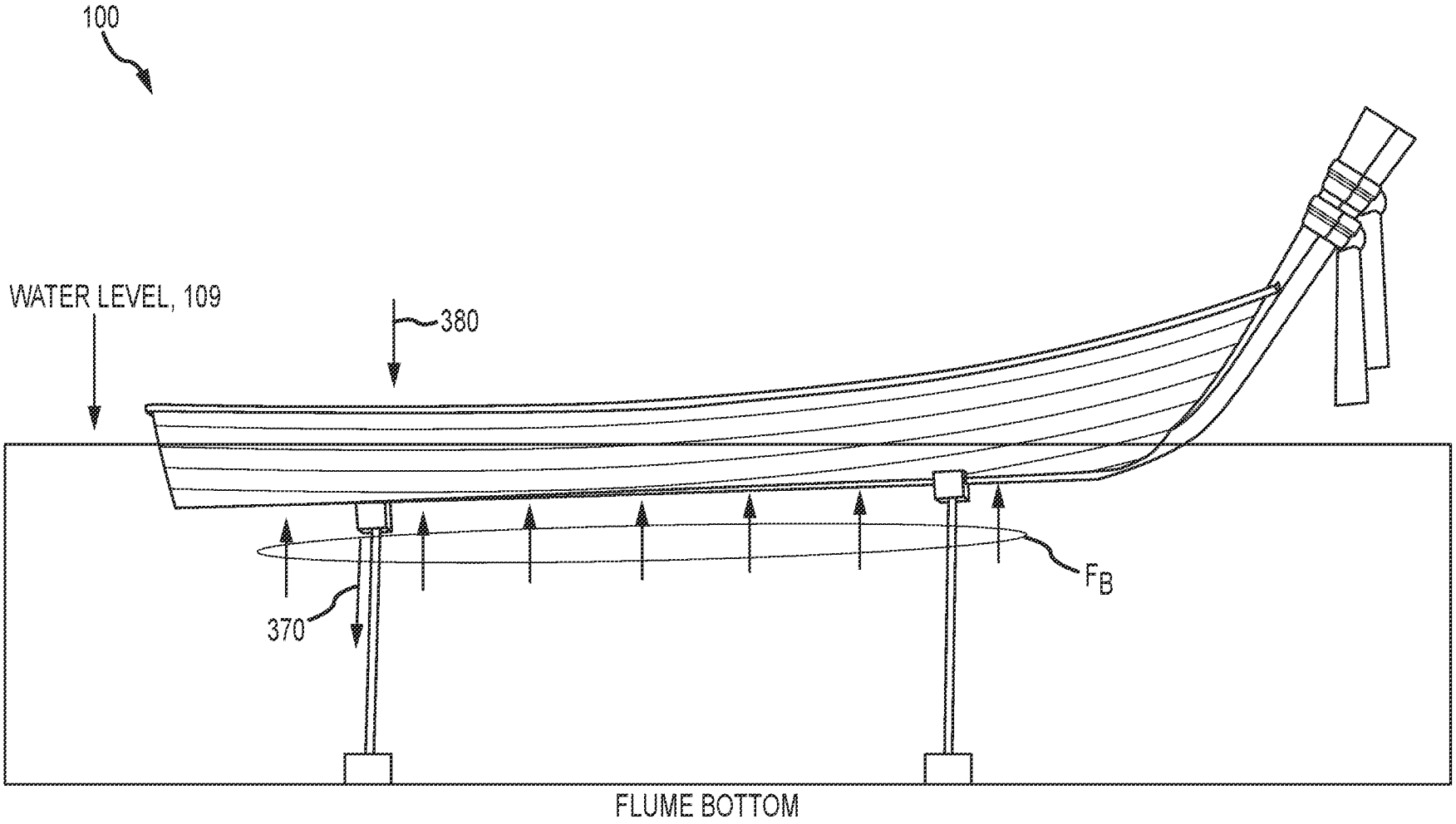
FIG. 3 is a side view similar to FIG. 2 during motion assembly operations to cause the passenger boat to surge rearward or the boat's stern to pitch downward.

FIG. 3 is a side view of the system 100 while it is operating the motion assembly 120 (such as after completion of the operations of FIG. 2) to cause the boat's rear end or stern 116 to pitch downward (or surge). During and prior to this motion, the water 108 is vertically supporting the boat 110 on the water surface 109 through buoyancy or applying buoyancy forces (as shown with arrows $F_B$) upon the underside or bottom surface 113 of the boat 110, which keeps the tethers 131-134 taught (e.g., with the lengths, $L_{Cable1}$, $L_{Cable2}$, $L_{Cable3}$, and $L_{Cable4}$, being equal to each other and/or matching to predefined nominal lengths in some cases). Then during the rearward pitch operating state, as shown, the stern or rear drivers 146, 148 are concurrently and equally operated to retract or pull the rear or stern tethers 133 and 134 downward toward the flume/pool bottom 104, as shown with arrow 370, which causes the rear end or stern 116 of the boat body 112 to move downward into the water 108 with them (or move further below the surface/water level 109). As shown, since the boat 110 is floating, the buoyant force shown with arrows $F_B$ keeps the bow or forward tethers 131 and 132 taut, and the boat's rear end or stern 116 pitches downward. This operating state may end with the tethers 133 and 134 being returned to their nominal lengths via operations of the drivers 146 and 148 to play out more of the tethers 133 and 134 (e.g., unwind the motorized reels), which causes the stern or rear end 116 to pitch back upward.

In FIG. 3, the front cables 131, 132 are left at nominal length and the rear cables 133, 134 are retracted as shown with arrow 370, which pulls 380 the rear end 116 of the boat 110 down. In either case, when the retracted cables are allowed to return to the nominal length (where the boat 110 is neutrally buoyant), the buoyant force, $F_B$, of the water 108 upon the boat 110 provides motion to the boat 110, which gives it an authentic "boat motion" feeling to the rider or passenger of the boat 110. When the motions shown in FIGS. 2 and 3 are combined into a sequence, the boat 110 is moved as if it were traveling over one-to-many waves (of size dictated by the length of tether that is retracted and later released (or amount of pitch)), with the bow 115 rising up and dropping and then the stern 116 following.

Since there are tethers 131, 132, 133, and 134 on all four corners of the chassis 121, a rolling motion can be applied to the boat 110 in a similar manner as discussed above for pitch motions. The roll operations of the motion assembly 120 generally involve the left side cables being retracted and released and then the right side cables are retracted and released, with this sequence being repeated as desired and a passenger in the boat 110 perceiving the boat motion as if waves are hitting the boat 110 perpendicularly.

Figure 4:
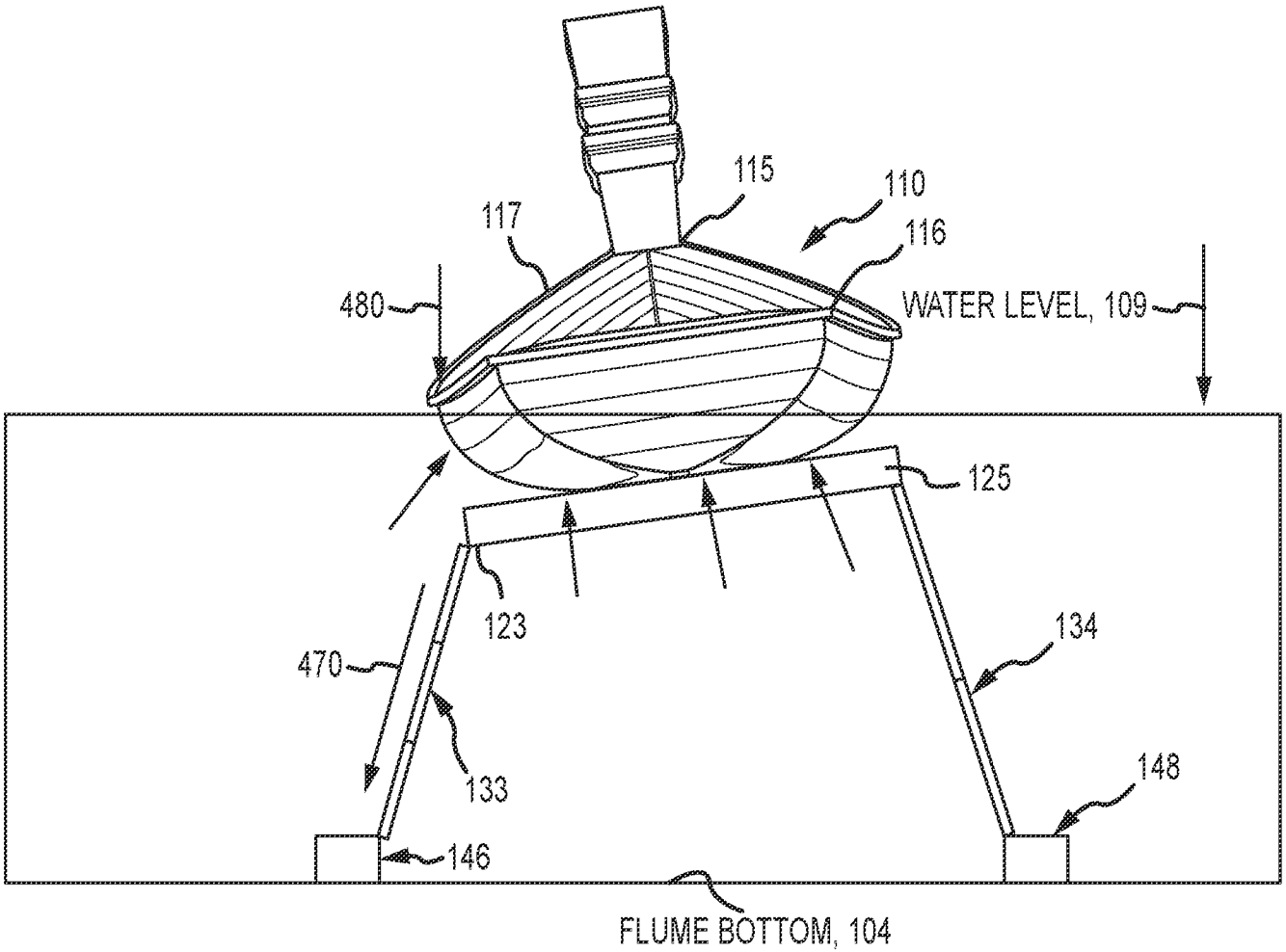
FIG. 4 is a rear view similar to FIGS. 2 and 3 during motion assembly operations to cause the passenger boat's port side to roll downward.

FIG. 4 is a rear view similar to FIGS. 2 and 3 during operations of the motion assembly 120 to cause the port side of the passenger boat 110 to roll downward. In the operating state shown in FIG. 4 for the motion assembly 120, the two left or port side tethers are pulled downward, with tether 133 visible and being pulled or retracted as shown with arrow 470 toward the flume bottom 104 by the driver 146 (and this also being the case for tether 131 by driver 141). Driver 148

(and driver 144) on the starboard or right side are not operated such that tether 134 (and tether 132) are left at nominal length. This operation causes, as shown with arrow 480, the left or port side of the boat 110 to be pulled down toward the flume/pool bottom 104. This operating state may end with the tethers 131 and 133 being returned to their nominal lengths via operations of the drivers 141 and 146 to play out more of the tethers 131 and 133 (e.g., unwind the motorized reels), which causes port or left side of the boat 110 to roll back upward to reach the natural boat motion provided by the buoyant forces, $F_B$, acting on the boat body 112.

Figure 5:
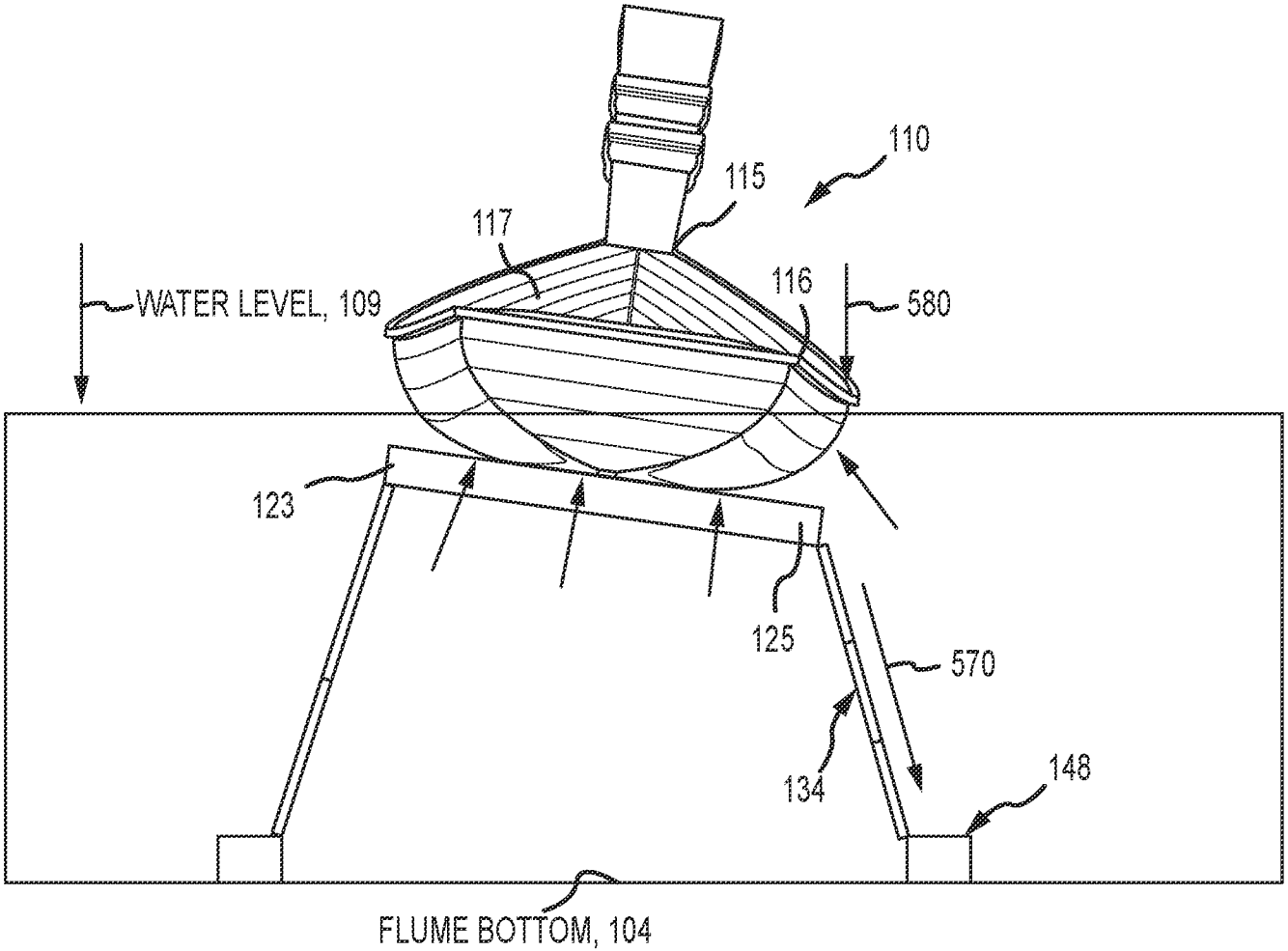
FIG. 5 is a rear view similar to FIG. 4 during motion assembly operations to cause the passenger boat's starboard side to roll downward.

FIG. 5 is a rear view similar to FIG. 4 during operations of the motion assembly 120 to cause the starboard side of the passenger boat 110 to roll downward. In the operating state shown in FIG. 5 for the motion assembly 120, the two right or starboard side tethers are pulled downward, with tether 134 visible and being pulled or retracted as shown with arrow 570 toward the flume bottom 104 by the driver 148 (and this also being the case for tether 132 by driver 144). Driver 146 (and driver 141) on the port or left side are not operated such that tether 133 (and tether 131) are left at nominal length. This operation causes, as shown with arrow 580, the right or starboard side of the boat 110 to be pulled down toward the flume/pool bottom 104. This operating state may end with the tethers 132 and 134 being returned to their nominal lengths via operations of the drivers 144 and 148 to play out more of the tethers 132 and 134 (e.g., unwind the motorized reels), which causes starboard or right side of the boat 110 to roll back upward to regain the natural boat motion provided by the buoyant forces, $F_B$, acting on the boat body 112.

In addition to the motions described above, each individual tether 131-134 can be retracted (and released back to nominal length) for a wide variety of motions such as to provide shuttering or vibrations (rapid and small retractions and releases of one or more driver), to provide heave (concurrent retraction of all drivers), and yaw. Specifically, the motion assembly 120 may operate similarly to a more typical motion simulator with controllable pitch, roll, heave, sway, and surge (with sway and surge possible via proper location of the cable reels on the flume/pool bottom 104). However, with the reliance on boat buoyance and the natural frequency associated with the buoyancy, the system 100 provided motions and a rider experience that is well beyond a typical motion simulator and provides an accurate or realistic boat motion simulator.

The boat motion simulation concepts described herein may be provided in a variety of system configurations to accommodate many creative concepts, visitor/passenger capacity requirements, and space constraints. These configurations include: (a) a single vehicle, single bay configuration; (b) a multi-vehicle, shared bay configuration; (c) a fleet simulator, single bay configuration; and (d) a traditional boat ride with boat motion simulation.

Figure 6:
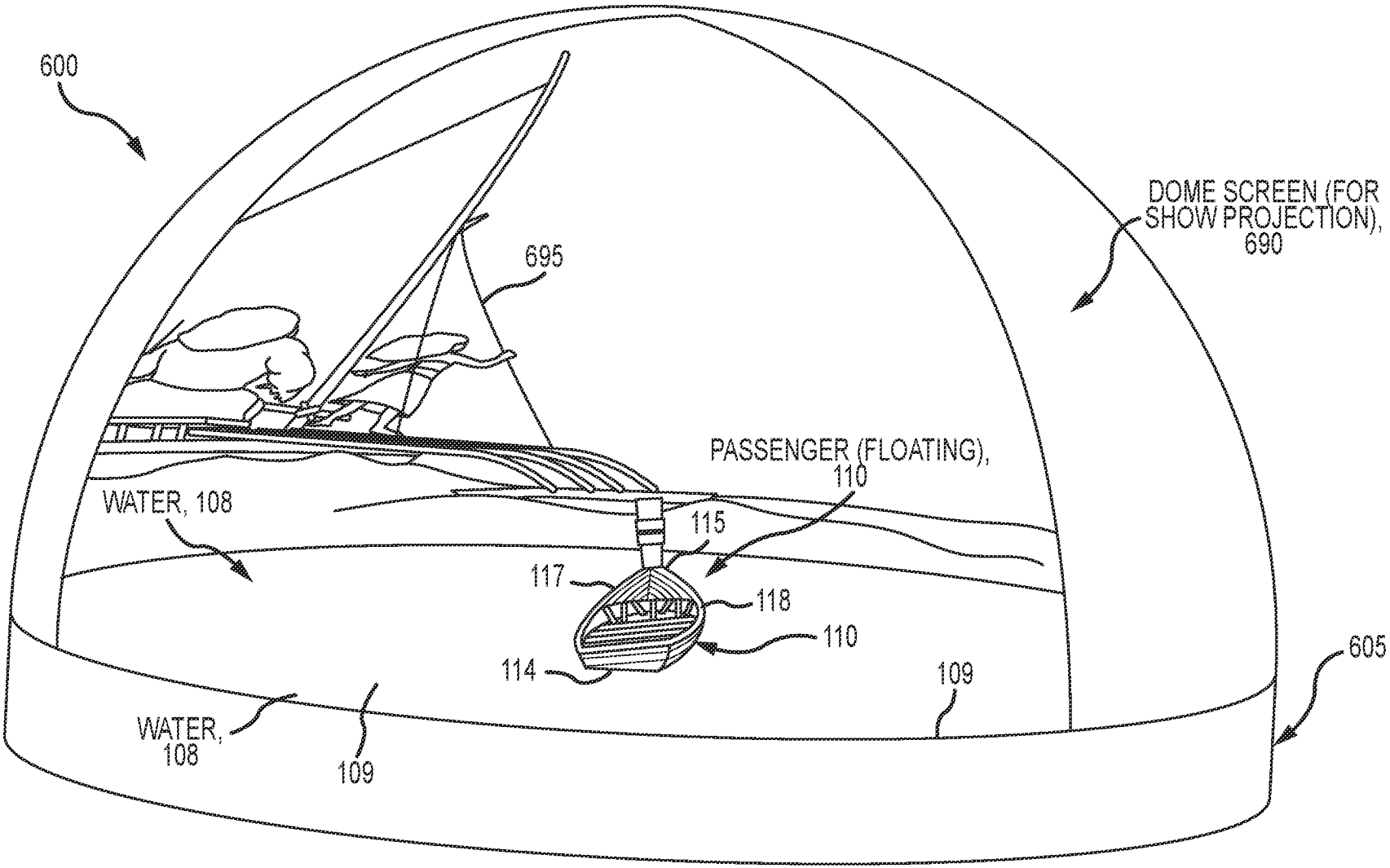
FIG. 6 illustrates another embodiment of a boat motion simulator in which visual and other effects are combined with the components shown for the system of FIG. 1 to enhance the passenger's experience.

The single vehicle, single bay configuration may include one vehicle in a single simulation space. FIG. 6 illustrates such a configuration with boat motion simulator or system 600, which includes a pool/flume 605 containing a volume of water 108 with a surface 109 (as discussed with reference to FIG. 1 and system 100). Additional components of the system 100 may be provided in system 600 including the passenger boat 110 and portions that provide the controlled motion of the boat 110 (not shown but understood from FIG. 1 as well as discussion of FIGS. 2-5).

The system 600 further includes a dome screen 690 for enclosing and defining a simulation space (interior volume of dome 690 over pool 605), and a display and audio system would be included (not shown but understood from FIG. 7) to present a surround (360-degree or some smaller amount) video image and associated soundtrack (and/or additional lighting or 4D effects such as rain or splashing water), and the motion assembly would be controlled to operate so as to be time synchronized with the show elements provided by the display and audio system, e.g., to provide pitch motions when waves are shown to strike the front/bow of the boat 110 and to provide roll motions when waves are shown to strike a side of the boat 110.

The single vehicle, single bay configuration of system 600 may be used to provide different experiences. One of these is a "passive experience" where passengers of the boat 110 see and feel the action (such as sailing across an ocean with a film character) but are restrained in the boat 110. Another experience is an "active experience" where passengers of the boat 110 are free (e.g., unrestrained) to perform tasks on the boat 110. This could include a pirate experience where passengers become the pirates or their targets and sail the ship 110 on the high seas while experiencing the real feeling of being in the open waters due to operations of the motion assembly.

The multi-vehicle, shared bay configuration has multiple vehicles that share a load/unload area and a simulation area or space. Only one vehicle is in a simulation space at a time (e.g., one vehicle is loading while another is experiencing the simulation of a boat ride). The fleet simulator, single bay configuration has multiple vehicles that share a single simulation space with multiple vehicles at the same time. This may be used to provide the passengers with an interactive experience where the passengers could decide which "side" of a battle to be on (e.g., on the pirate side or the traveler side or vice versa). The traditional boat ride with simulation may be designed to marry the "traditional" boat ride experience, where a boat is floating through a continuous flume, with the boat motion simulator to provide vehicle motion that has never been experienced on a traditional flume ride. This system would include additional equipment from that shown in FIGS. 1 and 6 such as a motion base for which the tethers can be attached (and drivers, typically) and which can be moved along a ride path to provide the linear motion typically seen in flume rides (e.g., the motion base takes the place of the pool bottom 104 of system 100).

Figure 7:
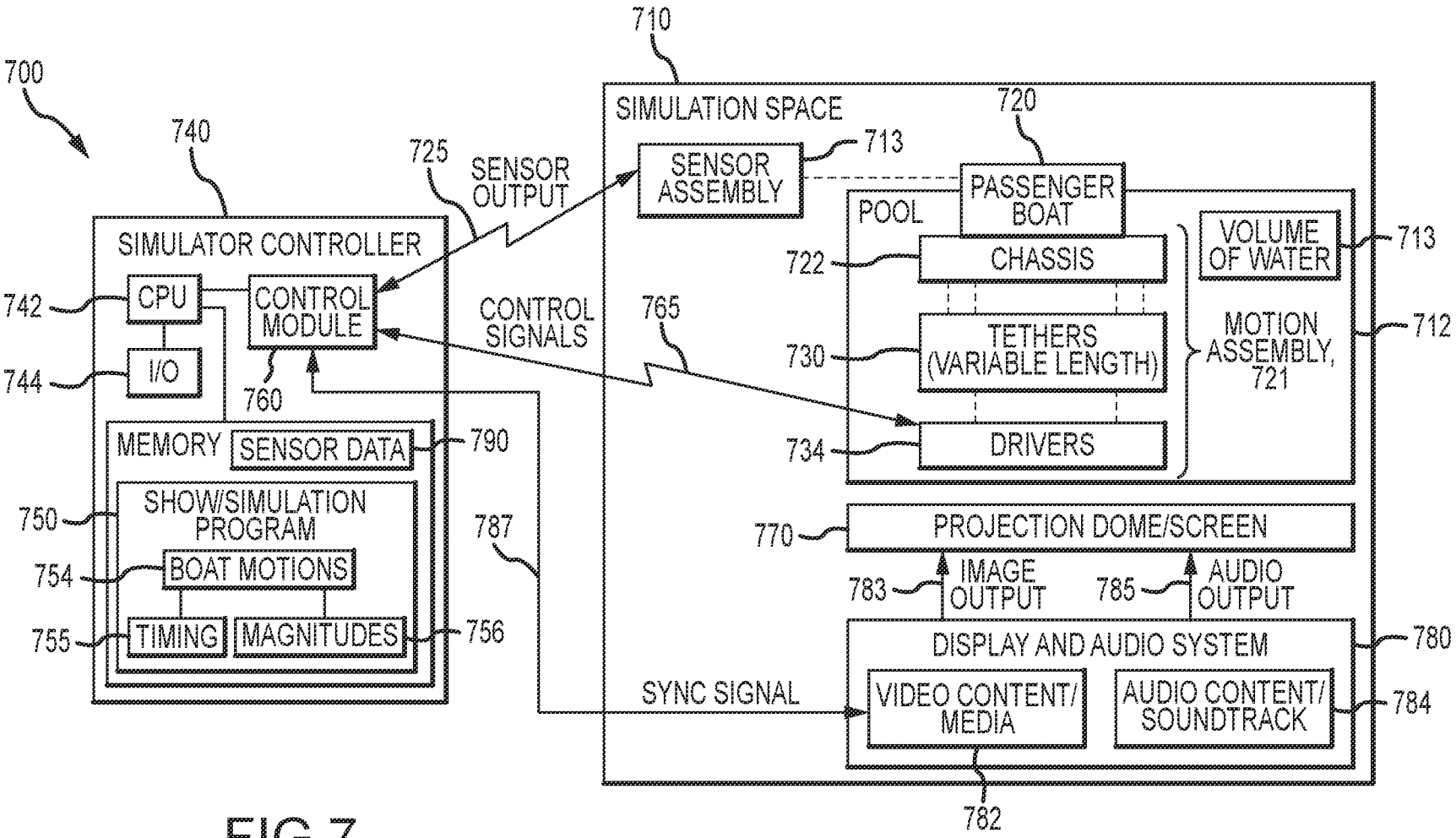
FIG. 7 is a functional block diagram of a boat motion simulator or system of the present description, as may be used to implement the system shown in FIG. 1.

FIG. 7 is a functional block diagram of a boat motion simulator or system 700 of the present description, as may be used to implement the system 100 shown in FIG. 1. As shown, the system 700 includes a simulation space or area 710 in which a pool/flume 712 is provided (e.g., with walls and a bottom surface defining a space for holding a predefined amount of liquid), and a volume of water 713 is held in the pool 712. Also, within the space, a passenger boat 720 is provided in the water 713 and allowed to float on its surface in response to buoyancy forces applied to the boat's hull or its body's underside/lower surface. A chassis 722 is provided on the underside of the boat's body (separate frame/structure mounted on the boat body or an integral component of the boat's body). Further, a sensor assembly 724 is provided to output data 725 indicative of the motions of the boat 720 and/or its present orientation (e.g., how is body oriented relative to horizontal to determine roll, pitch, and so on).

Additionally, as discussed for system 100 of FIG. 1, the system 700 includes a set of tethers 730 that are coupled to the chassis 722, such as at the corners of the chassis 722. The tethers 730 are typically formed of a flexible material (e.g., may be metal cables or the like) and have lengths that are varied during operation of the motion assembly 721. At a nominal length of the tethers 730, the boat 720 floats naturally (or with neutral buoyancy) in the water 713. The assembly 721 further includes a set of drivers 734 (i.e., one for each tether 730), which operate in response to control signals from a simulator controller 740 to set the lengths of each of the tethers 730. This may include operation of the drivers individually, in pairs, or in other combinations to achieve a desired boat-type motion (e.g., roll, sway, heave, pitch, surge, and yaw) by retracting one or more of the tethers 730 to reduce its length, which applies a motive force to the chassis 722 at the coupling location of an upper end of that tether 730 to the chassis 722 that acts to pull the boat down 720 into the water 713. Alternatively, the operations may involve operating the drivers 734 to release the tether 730 to increase their lengths and allow the buoyancy of the boat 720 in the water 713 to push the boat 720 back upwards (at the location of the tether couplings to chassis for the releases tethers).

The system 700 further includes a simulator controller 740 that may take the form of nearly any computing device, and it includes a processor 742 managing operations of input/output devices 744 to allow an operator to provide input and to communicate with the sensor assembly 724 (to receive sensor data 725 in a wired or wireless manner), with the drivers 734 (to send control signals 765 to the drivers 734), and with the display and audio system 780 to communicate signals 787 to synchronize operation of the drivers 734 with the output of image and audio as shown with arrows 783 and 785.

The processor 742 also executes code or program instructions, which may be stored in memory 750, to provide the functions of a control module 760. The memory 750 may also be used to store received sensor data 790 from the sensor assembly 724, which the module 760 processes to determine how the boat is presently oriented and/or its motions caused by drivers 734 (or waves in water 713) and to compare these with motions 754 defined in a show/simulation program 752 stored in memory 750 (or otherwise accessible by the control module 760). If needed, the control module 760 may modify operations of the drivers 734 with control signals 765 to have the sensed movements of the boat 720 better match those defined by the boat motions 754 in the program 752 (e.g., amount of retraction (or motion magnitude 756) may vary with differing loads, with differing levels of the water 713, and so on). The program 752 also defines timing 755 of the motions 754 as well as their magnitudes 756 (e.g., how much roll does the program require, which can be correlated with an amount of retraction of a tether 730 by a driver 734 or an amount of change in a length of a tether 730 by driver 734). The timing 755 is often synchronized by the module 760 with operations of the display and audio system 780 via communicated sync signals 787 so that the drivers 734 are operated to achieve desired motions 754 for boat 720 when appropriate for visual and audio outputs 783 and 785.

The system 700 further includes a projection dome and/or screen 770 in the simulation space 770. A display and audio system 780 is also provided in (or near) the space 710 with components (e.g., projectors) for outputting imagery 783 onto the projection dome/screen 770 using video content/media 782 (e.g., a 2D or 3D movie or the like), and the boat motions 754 of the show/simulation program 752 may be designed to suit the content/media 782 displayed 783 on the dome/screen 770 to enhance the experience provided to the passengers in the boat 720. Further, the system 780 includes audio equipment (e.g., speakers and the like) to output 785 audio using audio content or a soundtrack 784 paired with the video content/media 782. Again, the video and audio output 783 and 785 is typically synchronized with the motions 754 to achieve a desired experience (e.g., see and hear crash of waves against boat with the boat being moved by the drivers 734 and its natural buoyancy in the water 713 as if the waves were real).

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

For example, the tether/drivers pairs may be motorized reels to control a length of a flexible member such as a cable, but these pairs may take other forms such as actuators (e.g., hydraulic actuators, electric actuators, or the like). In such embodiments, the actuators would each be configured to have an active state in which they are causing desired movements of the chassis 121 relative to the flume/pool bottom 104 and a de-energized state in which the boat 110 is allowed to float on the water 108 naturally (e.g., whenever the retraction load is released).

The boat motion simulator is an entirely new concept that has not been attempted in any industry. The inventor recognized that it is very hard to mimic the motion of water in a way that a rider finds a vehicle movement is authentic. With the buoyancy force of the water playing a major part in the boat motion of the systems described herein, the boat motions will far exceed previous simulation attempts. The human body is amazingly attuned to motion that does not mimic natural motion. A floating boat is even more difficult to simulate because of the variability of loading conditions, weight, wave action, and so on. The new system's unique natural buoyancy feature accounts for these including naturally adjusting for the weight of the vehicle, balance of the vehicle, and motion of the water (wave action). It would be very difficult to program ride profiles for conventional actuation with all of this in mind for every ride cycle.

I claim:

1. A system for simulating boat motions, comprising:

a pool adapted to contain water to a predefined water level;

a volume of water in the pool;

a passenger boat on a surface of the volume of water; and a motion assembly comprising:

a chassis coupled to or integral with an underside of the passenger boat, wherein the chassis is positioned below the surface of the volume of water;

a plurality of tethers each with a first end coupled to the chassis; and a plurality of drivers each coupled with a second end of one of the tethers, wherein the passenger boat floats on the surface of the volume of water in response to buoyancy forces of the volume of water acting on the underside of the passenger boat when the tethers each have a nominal length, wherein a boat-type motion is imparted upon the passenger boat when one or more of the drivers operates to reduce a length of one or more of the tethers from the nominal length and to pull the passenger boat toward a bottom of the pool, and wherein each of the tethers comprises an elongated flexible member configured such that the motion assembly provides substantially no vertical support of the passenger boat when the boat-type motion is being imparted upon the passenger boat.

2. The system of claim 1, wherein a second boat-type motion is imparted upon the passenger boat when one or more of the drivers operates to return the one or more of the tethers to the nominal length, whereby the buoyancy forces act on the underside of the passenger boat to cause the passenger boat to again float naturally.

3. The system of claim 1, wherein the boat-type motion is selected from the group consisting of: roll, pitch, surge, heave, sway, yaw, and shuttering.

4. The system of claim 1, wherein the drivers each comprises a motorized reel upon which the second end of the tether is wound.

5. The system of claim 4, wherein the elongated flexible member comprises a cable.

6. The system of claim 1, wherein the tethers comprise four flexible members each with the first end coupled to one of four mounting points on the chassis and wherein the four mounting points are arranged in horizontal plane in a rectangular pattern.

7. The system of claim 6, wherein the rectangular pattern is configured such that two of the mounting points are located on a port side of the passenger boat, two of the mounting points are located on a starboard side of the passenger boat, two of the mounting points are located proximate to a bow end of the passenger boat, and two of the mounting points are located proximate to a stern end of the passenger boat.

8. The system of claim 1, wherein the drivers are independently and concurrently operable to modify lengths of the tethers and wherein each of the drivers or a pulley associated each of the drivers is positioned on the bottom of the pool.

9. A system for simulating boat motions, comprising:

a structure containing water;

a passenger boat in the water;

a chassis on a bottom surface of the passenger boat with four coupling members arranged in a rectangular pattern;

four cables each having a first end attached to one of the four coupling members; and four drivers each connected to a second end of one of the four cables, wherein the four drivers are independently and concurrently operable to pull the cables toward a bottom of the structure to selectively first pull the passenger boat toward the bottom of the structure by applying a downward force at one or more of the coupling members and second release the boat to rise up from the bottom of the structure, whereby a set of boat motions are applied sequentially to the passenger boat, and wherein each of the four cables comprises a flexible member and the passenger boat floats upon the water due to buoyancy forces when the four cables are at a nominal length.

10. The system of claim 9, wherein the rise up from the bottom is in response to buoyancy of the passenger boat in the water.

11. The system of claim 9, wherein pairs of the drivers are operated concurrently to impart at least one of pitch, roll, sway, and surge motions on the passenger boat.

12. The system of claim 9, wherein all four of the drivers are concurrently operated to impart heave or shuttering motions upon the passenger boat.

13. The system of claim 9, further comprising a projection dome enclosing a simulation space over a portion of the structure containing the water and a display and audio system projecting imagery and outputting audio paired with and time synchronized with the set of boat motions applied to the passenger boat.

14. The system of claim 9, wherein the rectangular pattern of the four coupling members has a width that matches or exceeds a width of the boat body.

15. A system for simulating boat motions, comprising:

a pool or flume containing water;

a passenger boat floating on a surface of the water; and a motion assembly comprising:

a chassis coupled to or integral with an underside of the passenger boat; and three or more actuators coupled at three or more coupling points with the chassis, wherein the passenger boat floats naturally on the surface of the volume of water in response to buoyancy forces acting on the underside of the passenger boat when the actuators are all in a de-energized state, and wherein a boat-type motion is imparted upon the passenger boat when one or more of the actuators operates to first impart a downward force on the chassis at one of the coupling points to pull the passenger boat toward a bottom of the pool and to second move to a de-energized state to allow the buoyancy forces to push the passenger boat back toward the surface of the water.

16. The system of claim 15, wherein the boat-type motion is selected from the group consisting of: roll, pitch, surge, heave, sway, yaw, and shuttering.

17. The system of claim 16, wherein opposite pairs of the actuators are sequentially operated to provide the roll and the pitch.

18. The system of claim 15, wherein each of the actuators comprises a driver and a tether coupled at a first end to one of the coupling points and at a second end to the driver, wherein each of the tethers comprises an elongated flexible member, and wherein the drivers each comprises a motorized reel upon which the second end of the tether is wound.

19. The system of claim 18, wherein the drivers are independently and concurrently operable to modify lengths of the tethers and wherein each of the drivers or a pulley associated each of the drivers is positioned on the bottom of the pool.

20. The system of claim 15, further comprising a projection dome enclosing a simulation space over a portion of the pool or flume containing the water and a display and audio system projecting imagery and outputting audio paired with and time synchronized with the boat-type motion.

* * * * *